US006178992B1

(12) United States Patent
Van Der Paal

(10) Patent No.: US 6,178,992 B1
(45) Date of Patent: Jan. 30, 2001

(54) HOSE REEL

(75) Inventor: Peter Antoon Van Der Paal, Kruibeke (BE)

(73) Assignee: Reels, Besloten Vennootschap Met, Beperkte Aanspra-Kelijkheid (BE)

( * ) Notice: Under 35 U.S.C. 154(b), the term of this patent shall be extended for 0 days.

(21) Appl. No.: 09/292,621

(22) Filed: Apr. 16, 1999

(30) Foreign Application Priority Data

Apr. 29, 1998 (BE) ..... 9800323

(51) Int. Cl.[7] ..... B65H 75/34

(52) U.S. Cl. ..... 137/355.2; 137/355.21; 137/355.22; 137/355.26; 138/104; 138/127; 242/390.2

(58) Field of Search ..... 137/355.2, 355.21, 137/355.22, 355.26; 138/104, 127; 242/390.8

(56) References Cited

U.S. PATENT DOCUMENTS

| | | | | |
|---|---|---|---|---|
| 1,659,788 | * | 2/1928 | Sipkovitz | 137/355.26 |
| 2,610,810 | * | 9/1952 | Pelouch | 137/355.2 |
| 2,669,483 | | 2/1954 | Fletcher . | |
| 2,963,227 | | 12/1960 | Lambert . | |
| 4,288,653 | * | 9/1981 | Blom et al. | 174/47 |
| 4,487,218 | * | 12/1984 | Sifri | 137/355.26 |
| 4,730,089 | | 3/1988 | Pepper . | |
| 4,993,449 | * | 2/1991 | Stutzman et al. | 137/355.26 |
| 5,183,218 | * | 2/1993 | Gavagna | 242/390.8 |
| 5,289,845 | * | 3/1994 | Sipos et al. | 137/355.27 |
| 5,402,551 | | 4/1995 | Workhoven et al. . | |
| 5,495,995 | * | 3/1996 | Dominnique et al. | 242/390.8 |
| 5,709,350 | * | 1/1998 | Davis et al. | 242/390.8 |
| 5,947,148 | * | 9/1999 | DeVito | 137/355.26 |

FOREIGN PATENT DOCUMENTS

| | | |
|---|---|---|
| 39 21 679 A1 | 1/1991 | (DE) . |
| 1235380 | 3/1960 | (FR) . |
| 1284097 | 1/1962 | (FR) . |

* cited by examiner

*Primary Examiner*—A. Michael Chambers
*Assistant Examiner*—Thomas L. McShane
(74) *Attorney, Agent, or Firm*—Bacon & Thomas, PLLC

(57) ABSTRACT

An improved reeling device including a reel driven by an electric motor. The device further includes a hose having first and second ends and two electric conductors running along the entire length of the hose between the first and second ends of the hose. The hose is wound on the reel. The first end of the hose is connectable to a tool, and the second end of the hose is connected to the reeling device. The conductors at the second end of the hose extend from the hose such that one of the conductors is in communication with the motor and the other conductor is attached to a part of the reel device. A switch is connected to the conductors at a proximity of the first end of the hose and the switch is arranged to complete an electrical circuit.

9 Claims, 2 Drawing Sheets

HOSE REEL

BACKGROUND OF THE INVENTION

1. Field of the Invention

The present invention relates to an improved hose reel, in other words, a reel for winding and unwinding a hose for transporting a medium, more particularly for the transport of compressed air from this reel by the hose being in connection therewith to a compressed-air tool.

2. Description of the Related Art

It is known that with a classic reel driven by a spring, when drawing off the air hose, a spring is wound. As soon as the hose is let loose, the aforementioned spring will provide the tension for rewinding the hose.

Such reels driven by a spring substantially show two important disadvantages.

A first disadvantage is that involuntarily letting go of the hose during winding or unwinding will lead to very dangerous circumstances, in view of the fact that the hose at such a moment will be wound up in a rapid and uncontrolled way.

Another disadvantage of such reels driven by a spring is that, due to the tensioning of the spring, the force necessary to draw off the hose increases as a larger length of hose is unwound, as a result of which such spring reels become unsuitable for applications with a high usage frequency such as, for example, in production lines, assembly lines and such, in consideration of the fact that they result in an unnecessary tiring of the users of such a reel.

Another disadvantage of the reel driven by a spring is that one always has to search for the blocking position thereof.

Also, motor-driven reels are already known which are provided with a friction coupling, which also leads to various disadvantages.

A first disadvantage of these latter reels consists in that the force which is necessary to draw off the hose is related to the height at which the reel is placed and the weight of the hose, such that with heavier hoses and/or larger heights of the reel, the friction coupling has to be tensioned in order to prevent a spontaneous dropping of the hose. By tensioning the friction coupling, however, the pulling force which is necessary to draw of the hose is significantly increased such that, even with a reel which is mounted lower, the force which is necessary to draw off the hose in most cases is experienced as too large.

Another disadvantage of motor-driven reels with friction coupling is that, due to wear and tear, the coupling regularly has to be readjusted. Such reels, thus, are not maintenance-free. The exact adjustment of the friction coupling requires a lot of time and knowledge. Furthermore, such couplings often are not easily accessible.

Still another disadvantage of known reels with friction coupling is that the automatic winding of the reel only starts when the user has placed his tools into the tool holder in the proximity of the reel which means that the user, during his movement towards the reel, has to step over the hose and therefore has to take care not to stumble, and at the same time has to take care that, during the automatic winding of the hose, the latter does not unexpectedly get behind the user and/or other objects.

Another disadvantage of certain reels with friction coupling consists in that the signal for winding the hose is given by means of a tool holder which is equipped with a detection mechanism, which has as a disadvantage that the winding procedure of the hose can be activated by a third party in an undesired manner.

Other known reels comprise an electromagnetic coupling, but these also show various disadvantages.

A first disadvantage of this latter known reel consists in that a fast jerk at the hose may lead to so-called "spinning", whereby the reel drum rotates rapidly and unwinds more hose than desired, as a result of which the hose will heap up and a crisscross of hose will occur which can hamper, if not block, the drive.

Still another disadvantage of such reels with electromagnetic coupling consists in that, with a complete uncoupling between drive and reel drum, the drum, due to its mass inertia, will remain rotating for a period of time and will drop an undesired length of hose, as a result of which a heap of hose is created, again with the risk of stumbling or such as a result.

SUMMARY OF THE INVENTION

The present invention aims at avoiding the aforementioned and other disadvantages of existing reels and provides a reel whereby only the desired quantity of hose length is unwound, wound, respectively, in such a manner that an exact length of hose is always unwound for a certain work and the unwinding, winding, respectively, is controlled at each moment and is completely independent from the height at which the reel is placed and/or the weight of the hose. The unwinding, winding, respectively, of the hose is performed at the desired moment and can be stopped at the desired moment by operating the unwinding mechanism, winding mechanism, respectively, of the reel, at the location of the free extremity of the hose, at the location of the tool connected to such free extremity, respectively.

Such an improved reel according to the invention comprises of the type whereby a quantity of hose is wound on an actual reel and of the type whereby this hose, at one extremity, is connected or can be connected to a tool and, at its other extremity, is connected in a suitable manner to a medium, for example, a compressed-air source. Thereafter, the actual reel can be driven in a suitable manner by an electric motor, compressed-air motor. Through the entire hose, electric conductors are running which, in the proximity of the free extremity of the hose, are connected to a push-button switch and which, at their other extremity, respectively, are connected to the aforementioned motor and a power source, possibly by an electronic control board with microprocessor, in order to be able to close a suitable electrical circuit through the motor.

In such an improved reel according to the invention, preferably a driving motor with a low transmission shall be applied, as a result of which an easy manual unwinding of the hose without an additional coupling is obtained.

In an improved reel according to the invention, the winding of the hose shall be performed by a push-button switch at the extremity of the hose, as a result of which this hose will be wound, as the user is going back to his starting position, in other words, to the reel, and whereby the speed of automatic winding will be determined and regulated by the user himself by using the push-button switch.

Since the reel always remains coupled to the motor, no "spinning" will occur.

Preferably, such improved reel according to the invention will also be provided with a brake, as a result of which the compressed-air tools, without additional support of a tool holder, can be suspended freely at the reel, on one hand, and during a power failure, it is prevented that the tools concerned might drop downward, on the other hand.

Finally, the improved reel according to the invention will be provided with a pulse detection system, whereby the number of pulses during unwinding the hose is counted such that this number of pulses is counted backward when winding the hose, whereby, at a certain number of pulses from the starting position of unwinding the hose, the speed of the motor will be reduced electronically until the moment when the pulse detection has reached zero again.

BRIEF DESCRIPTION OF THE DRAWINGS

With the intention of better showing the characteristics of the invention, hereafter, as an example without any limitative character, a preferred form of embodiment of an improved reel according to the invention is described, with reference to the accompanying drawings, wherein.

DETAILED DESCRIPTION OF THE PREFERRED EMBODIMENT

Figure 1:
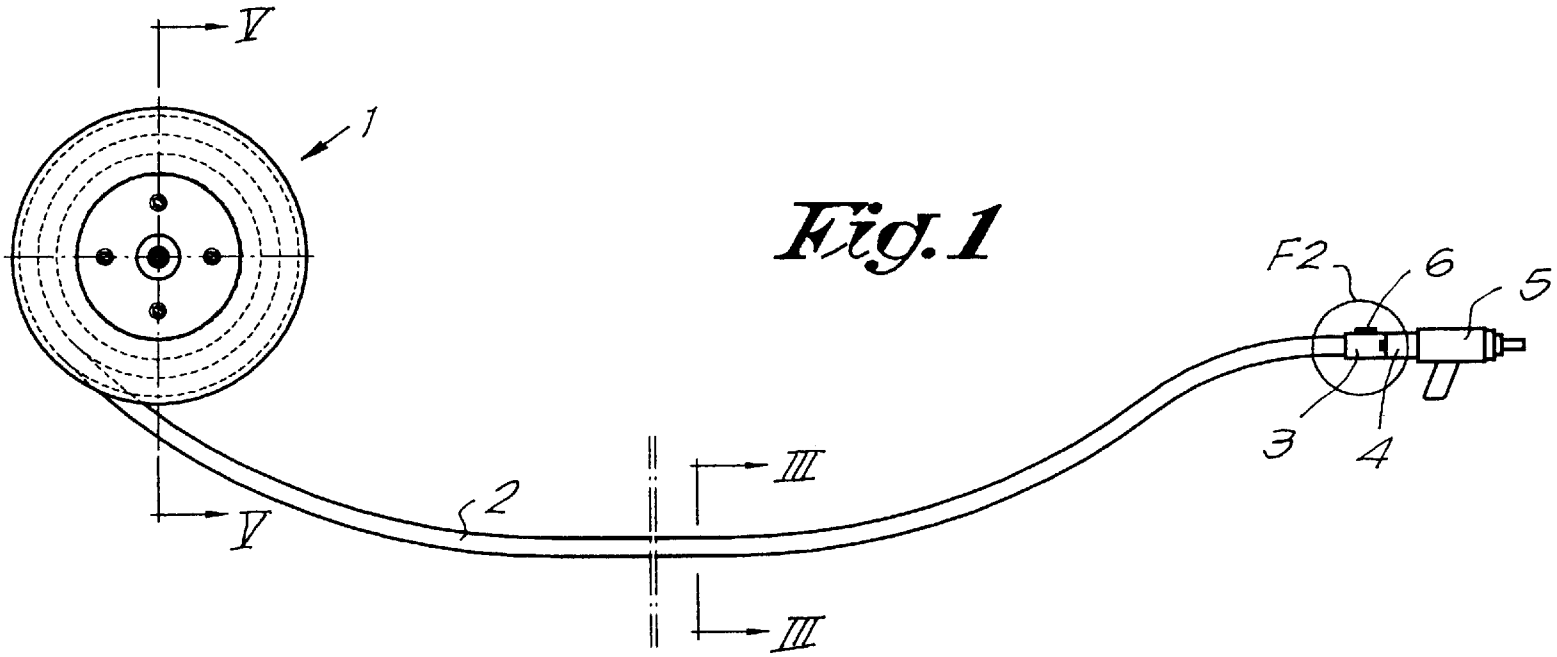
FIG. 1 schematically represents a reel according to the invention, with partially unwound hose.
Figure 2:
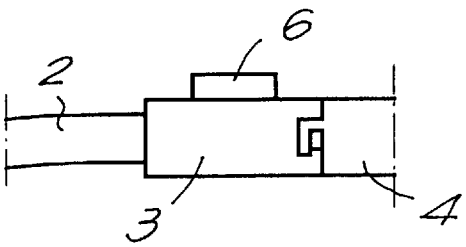
FIG. 2 represents the portion which is indicated by F2 in FIG. 1.

In FIG. 1, an improved reel 1 according to the invention is represented onto which a hose 2 is wound which, at its free extremity, has a connection piece 3 with which a connection piece 4 of a working tool 5 can be connected in a suitable manner, preferably by of a bayonet coupling or such.

In the represented embodiment, the connection piece 3 is provided with a switch, more particularly a push-button switch 6, which is connected to electrical conductors 7–8 which are provided through the hose 2, over the entire length, and which, at their other extremity, are connected, on one hand, to a connection terminal 9 of a driving motor 10 of the reel 1 according to the invention and, on the other hand, to the metal housing or earth of the reel 1.

The second connection terminal 11 of the motor 10 is connected further, by a conductor 12 to a slip ring 13 with which a brush 14 is cooperating which, by a conductor 15, is connected to a suitable power source, the second pole of which is connected to the earth of the reel 1, by a conductor 16.

The slip ring 13 is suitably connected to the hub 17 of the reel 1, whereby a pulley 18 is fixed at this hub 17 The pulley 18 cooperates with a pulley 19 positioned at the exiting shaft of the motor 10, whereby these pulleys 18–19 are connected to each other by a belt 20.

Finally, the reel 1 is freely rotatable on a pipe-shaped shaft 21 which also provides for the supply of compressed air to the hose 2, to which aim this pipe-shaft shaft 21 is fixedly attached in respect to the frame 22 of the reel 1 and, on one hand, and, on the other hand, is connected, by suitable connections 23 and 24 known in themselves, to the actual compressed-air supply pipe 25 and to conduit 26 which is in connection with the extremity of the hose 2 wound onto the reel 1.

Figure 3:
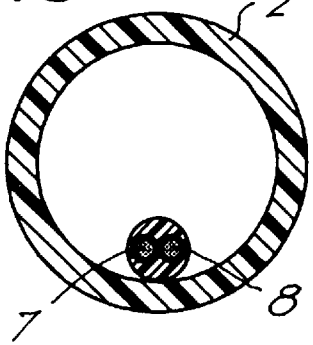
FIG. 3 represents a cross-section taken along line III—III of FIG. 1.
Figure 4:
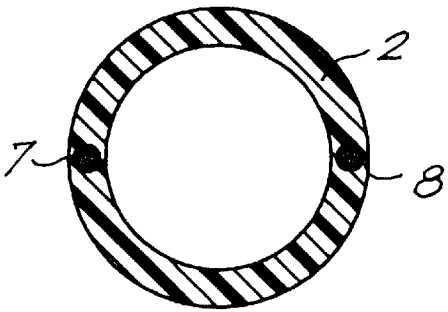
FIG. 4 represents a variant of FIG. 3.
Figure 5:
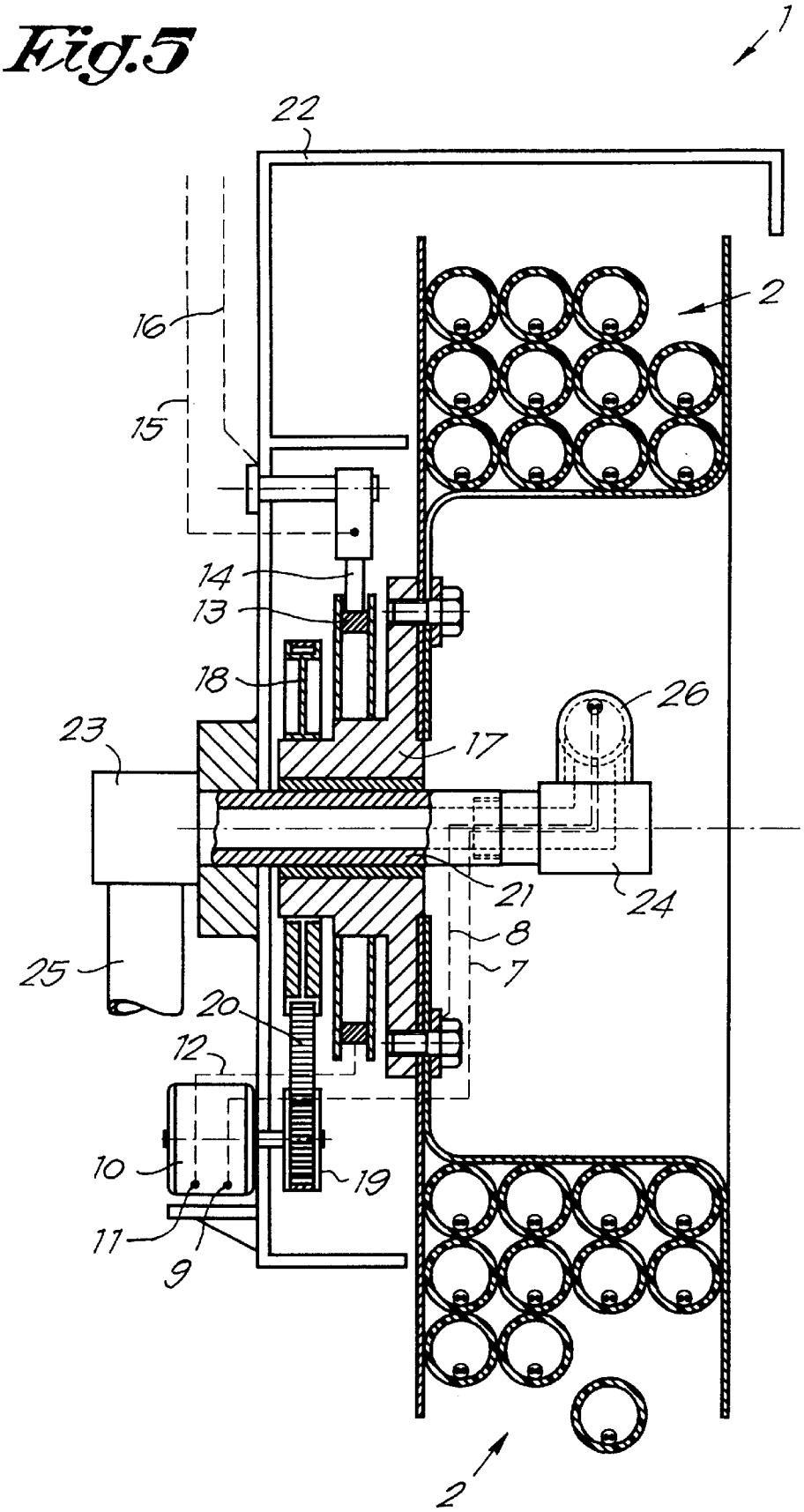
FIG. 5 represents a cross-section taken along line V—V of FIG. 1.

Finally, the reel 1 is suspended from a ceiling or such in a suitable manner.

Where an embodiment is represented in FIG. 3 whereby the conductors 7 and 8 are provided freely in the hose, it is clear that, as indicated in FIG. 4, these conductors 7–8 eventually can be provided in the wall thickness of the hose 2 and this either according to the longitudinal direction of the hose or spirally.

The application of the improved reel according to the present invention is very easy and as follows.

In order to unwind a quantity of hose 2 from the reel 1, it suffices to grasp either the hose at the connection piece 4 or, if a tool is provided, at the tool 5 and to unwind the desired quantity of hose manually by pulling at the hose.

In order to subsequently wind the hose, it will suffice to push the push-button 6, as a result of which an electric circuit is closed through the driving motor 10 which will wind the hose again, whereby this winding will be controlled by the person holding the tool 5, in such a manner that the hose is wound up at a speed which is equal to the moving speed of the user of the tool 5.

In this manner, a very safe reel is obtained, as a result of which only the desired quantity of hose has to be unwound and whereby the hose is only wound as the user of the hose either pushes the push-button 6 or not.

In the case that the reel according to the invention is provided with an electronic control board with microprocessor, the aforementioned push-button switch 6 needs to be pushed in order to give short pulses, whereby, for example, a short pulse during standstill starts the automatic winding of the hose; a short pulse during the automatic winding results in that the automatic winding is stopped, and a long pulse during standstill may result in that the winding speed is adjusted.

Of course, in this last case, all other working schemes will have to be considered, too.

Preferably, the aforementioned electronic winding system will also be equipped with a power safety, in such a manner that, when the hose 2 during winding becomes stuck at something, the electronic winding system automatically stops the winding.

Thus, it is clear that with the reel according to the invention, there is never too much hose which will lie on the ground and over which one might stumble or the like, whereas the winding of the hose always remains under control.

It is clear that the present invention is in no way limited to the form of embodiment described by way of example and represented in the accompanying drawings, but that such reel can be realized in a variety of forms and dimensions without leaving the scope of the invention.

What is claimed is:

1. An improved reeling device comprising:

a reel driven by an electric motor;

a hose including first and second ends and at least two electric conductors running along the entire length of the hose between the first and second ends of the hose, the hose wound on the reel;

the first end of the hose connectable to a tool;

the second end of the hose connected to the reeling device;

the conductors at the second end of the hose extending from the hose such that one of the conductors is in communication with the motor and the other conductor is attached to a part of the reeling device; and a switch connected to the conductors at a proximity of the first end of the hose, the switch arranged to complete an electrical circuit.

2. The reeling device as claimed in claim 1, wherein the electric conductors run freely through the hose.

3. The reeling device as claimed in claim 1, wherein the hose includes a wall thickness and the electric conductors are provided within the wall thickness of the hose.

4. The reeling device as claimed in claim 1, wherein the reel device further includes a power source, a hub, a slip ring attached to the hub, a brush in communication with the slip ring and connected to the power source, and the motor includes a metal housing and first and second connection terminals, one of the electric conductors at the second end of the hose connected to the first connection terminal and another one of the electrical conductors at the second end of the hose connected to the metal housing of the motor, and the second connection terminal connected to the slip ring.

5. The reeling device as claimed in claim 1, wherein an electronic control board with a microprocessor is provided in the electric circuit.

6. The reeling device as claimed in claim 1, wherein the switch is a push-button switch.

7. The reeling device as claimed in claim 1, wherein the electric motor drives the hub of the hose reel.

8. The reeling device as claimed in claim 7, wherein a first pulley is provided on the shaft of the electric motor, a second pulley attached at the hub of the hose reel and a belt secured on the pulleys.

9. The reeling device as claimed in claim 1, wherein the reel is provided with a pulse detection system which counts the number of pulses during winding and unwinding of the reel in such a manner that at a certain number of pulses from zero, the speed of the motor is reduced electronically up to a moment when the number of pulses has reached zero again.

* * * * *